US007995028B2

(12) United States Patent
Yeo et al.

(10) Patent No.: US 7,995,028 B2
(45) Date of Patent: Aug. 9, 2011

(54) TIMING CONTROLLER, LIQUID CRYSTAL DISPLAY COMPRISING THE SAME AND DRIVING METHOD OF LIQUID CRYSTAL DISPLAY

(75) Inventors: Dong-min Yeo, Daegu (KR); Gi-cherl Kim, Yongin-si (KR); Young-keun Lee, Cheonan-si (KR); Yong-hoon Kwon, Asan-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 515 days.

(21) Appl. No.: 12/234,160

(22) Filed: Sep. 19, 2008

(65) Prior Publication Data

US 2009/0108761 A1 Apr. 30, 2009

(30) Foreign Application Priority Data

Oct. 25, 2007 (KR) ..... 10-2007-0107991

(51) Int. Cl.
*G09G 3/36* (2006.01)

(52) U.S. Cl. ..... 345/102; 345/207

(58) Field of Classification Search ..... 345/82, 345/84, 102, 204, 207, 690, 697
See application file for complete search history.

(56) References Cited

U.S. PATENT DOCUMENTS

| | | | | |
|---|---|---|---|---|
| 7,719,512 | B2 * | 5/2010 | Kwon | 345/102 |
| 7,893,917 | B2 * | 2/2011 | Baba et al. | 345/102 |
| 2006/0279523 | A1 * | 12/2006 | Nitta et al. | 345/102 |
| 2007/0002003 | A1 * | 1/2007 | Kim | 345/102 |
| 2009/0184906 | A1 * | 7/2009 | Park et al. | 345/84 |

FOREIGN PATENT DOCUMENTS

KR 1020070067958 A 6/2007

* cited by examiner

*Primary Examiner* — Thuy Vinh Tran
(74) *Attorney, Agent, or Firm* — F.Chau & Associates, LLC

(57) ABSTRACT

A timing controller, a liquid crystal display (LCD) comprising the same and a driving method of the liquid crystal display, in which the LCD includes an LCD panel, a light source unit divided into n light-emitting blocks providing light to the LCD panel, a side member reflecting the light emitted from the light source unit, a timing controller determining a final brightness of each of the n light-emitting blocks and providing final light data corresponding to the final brightness, the final brightness being determined using reflected brightness based on the light reflected from the side member, and a backlight driver controlling the brightness of each of the n light-emitting blocks in response to the final light data.

20 Claims, 12 Drawing Sheets

FIG. 5C

CW SW W

| | | | | |
|---|---|---|---|---|
| 0.1 | 0.1 | 0.1 | 0.1 | 0.1 |
| 0.1 | 0.2 | 0.5 | 0.2 | 0.1 |
| 0.1 | 0.3 | LBj | 0.3 | 0.1 |
| 0.1 | 0.2 | 0.5 | 0.2 | 0.1 |
| 0.1 | 0.1 | 0.1 | 0.1 | 0.1 |

TIMING CONTROLLER, LIQUID CRYSTAL DISPLAY COMPRISING THE SAME AND DRIVING METHOD OF LIQUID CRYSTAL DISPLAY

CROSS-REFERENCE TO RELATED APPLICATION

This application claims priority from Korean Patent Application No. 10-2007-0107991 filed on Oct. 25, 2007 in the Korean Intellectual Property Office, the disclosure of which is incorporated herein by reference in its entirety.

BACKGROUND OF THE INVENTION

1. Technical Field

The present disclosure relates to a timing controller, a liquid crystal display comprising the same, and a driving method of the liquid crystal display.

2. Discussion of Related Art

A liquid crystal display (LCD) generally includes an LCD panel having a first panel having pixel electrodes, a second panel having a common electrode, a liquid crystal (LC) layer having dielectric anisotropy and interposed between the first and second panels. An electric field is formed between the pixel electrode and the common electrode, and the amount of light transmitted through the LCD panel is controlled by adjusting the intensity of the electric field, thereby displaying a desired image.

Because the LCD is not a self-emitting light display, in order to display an image with a desired high level of brightness, it needs various light emissive devices. In this regard, a timing controller provides light data for controlling the various light emissive devices.

SUMMARY OF THE INVENTION

Exemplary embodiments of the present invention provide a timing controller that can improve a display quality.

Exemplary embodiments of the present invention also provide a liquid crystal display that can improve a display quality.

Exemplary embodiments of the present invention also provide a method of driving a liquid crystal display that can improve a display quality.

The above and other exemplary embodiments of the present invention will be described in or be apparent from the following descriptions of the exemplary embodiments.

According to an exemplary embodiment of the present invention, there is provided a timing controller surrounded by a side member reflecting light and supplying light data to a light source unit divided into a plurality of light-emitting blocks, the timing controller including a target-brightness-determination unit receiving the image data and determining the target brightness of the ith light-emitting block ($1 \leqq i \leqq n$), an initial brightness-determination unit determining the initial brightness of the ith light-emitting block corresponding to the target brightness of the ith light-emitting block and lower than the target brightness, a medium-brightness-determination unit determining the spreading brightness of the jth light-emitting block for ith light-emitting block ($1 \leqq i \leqq n$) determined by the light spread from the jth light-emitting block ($1 \leqq j \leqq n, j \neq i$), determining the reflected brightness of the jth light-emitting block for the ith light-emitting block, and determining the median brightness of the ith light-emitting block by adding the initial brightness, the reflected brightness and the spreading brightness, the reflected brightness of the jth light-emitting block for the ith light-emitting block being determined by the light emitted from the jth light-emitting block, reflected by the side member and the reflected light, a comparator comparing the median brightness with the target brightness, and a corrector correcting the median brightness according to the compared brightness information, determining the final brightness of the ith light-emitting block, and supplying the light data corresponding to the initial brightness.

According to an exemplary embodiment of the present invention, there is provided a liquid crystal display (LCD) including an LCD panel, a light source unit divided into n light-emitting blocks providing light to the LCD panel, a side member reflecting the light emitted from the light source unit, a timing controller determining a final brightness of each of the n light-emitting blocks and providing final light data corresponding to the final brightness, the final brightness being determined using reflected brightness based on the light reflected from the side member, and a backlight driver controlling the brightness of each of the n light-emitting blocks in response to the final light data.

According to an exemplary embodiment of the present invention, there is provided a driving method of a liquid crystal display (LCD) including providing an LCD comprising an LCD panel, a light source unit divided into a plurality of light-emitting blocks, and a side member reflecting light supplied from the light source unit, determining the final brightness of each of the plurality of light-emitting blocks, the final brightness being determined using reflected brightness determined by the light reflected from the side member, supplying light data corresponding to the final brightness, and controlling the brightness of one of the plurality of light-emitting blocks in response to the light data.

BRIEF DESCRIPTION OF THE DRAWINGS

Exemplary embodiments of the present invention will be understood in more detail from the following descriptions taken in conjunction with the attached drawings, in which:

FIGS. 5B through 5E are conceptual diagrams for explaining the operation of an intermediate-brightness-determining unit shown in FIG. 4;

DETAILED DESCRIPTION OF EXEMPLARY EMBODIMENTS

Figure 1:
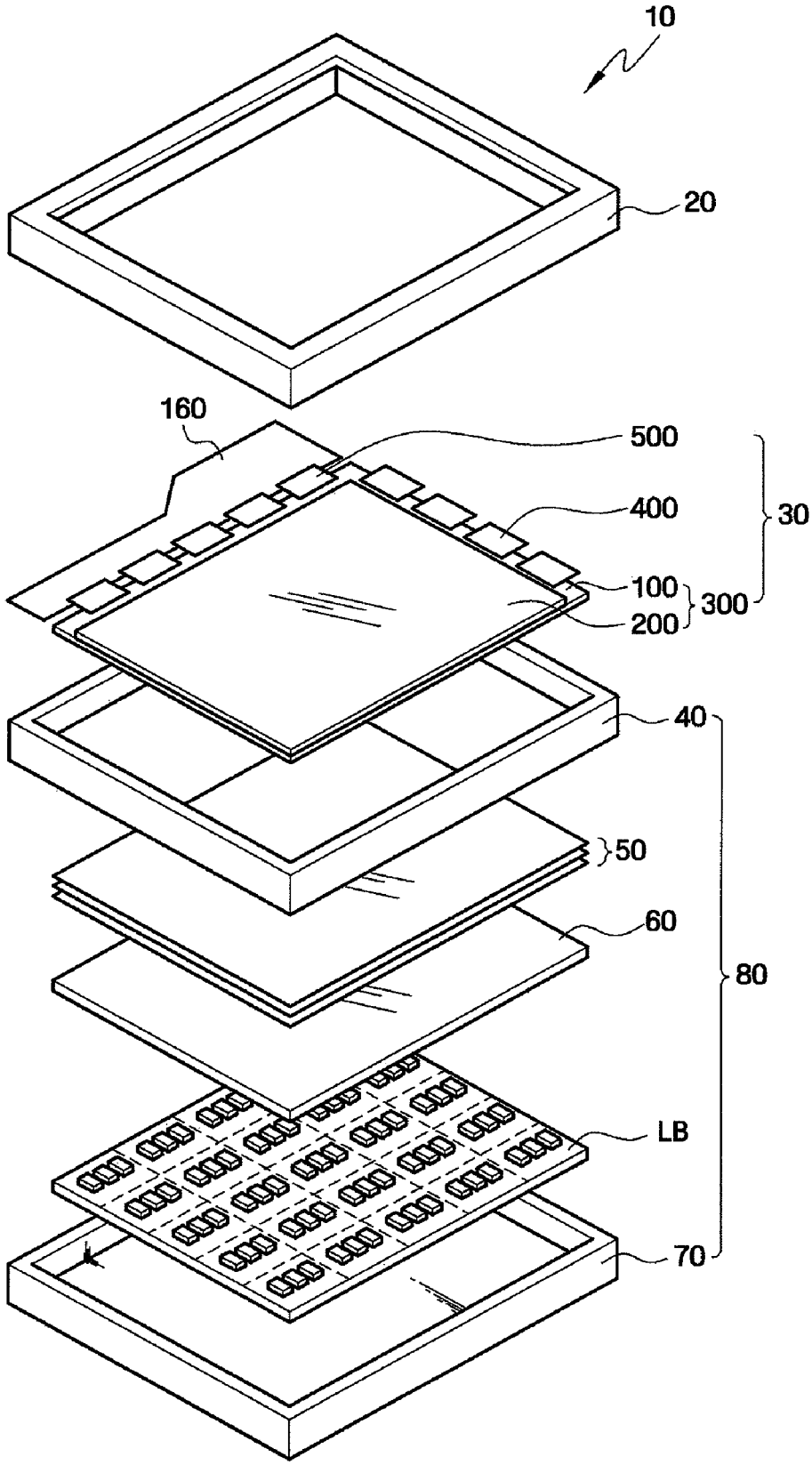
FIG. 1 is an exploded perspective view of a liquid crystal display (LCD) according to an exemplary embodiment of the present invention.

Advantages and features of the present invention and methods of accomplishing the same may be understood more readily by reference to the following detailed description of exemplary embodiments and the accompanying drawings. The present invention may, however, be embodied in many different forms and should not be construed as being limited to the exemplary embodiments set forth herein. Rather, these exemplary embodiments are provided so that this disclosure will be thorough and complete and will fully convey the concept of the invention to those of ordinary skill in the art, and the present invention will only be defined by the appended claims. Like reference numerals refer to like elements throughout the specification.

Figure 3:
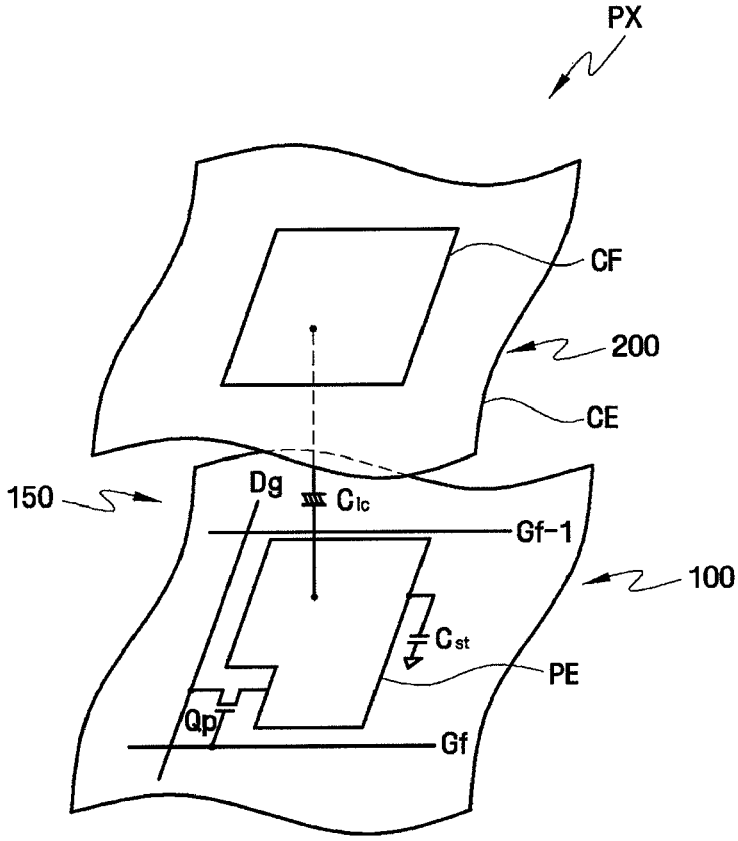
FIG. 3 is an equivalent circuit diagram of one pixel of the LCD shown in FIG. 1.
Figure 4:
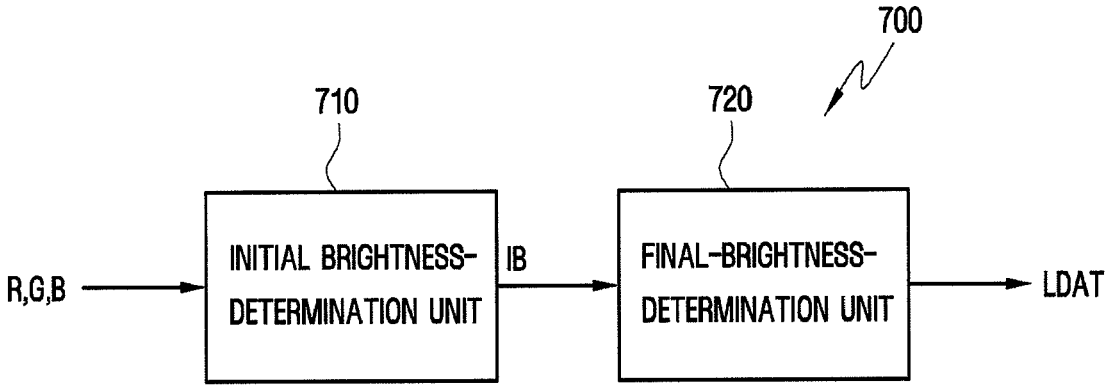
FIG. 4 is a block diagram of the timing controller shown in FIG. 1.
Figure 5A:
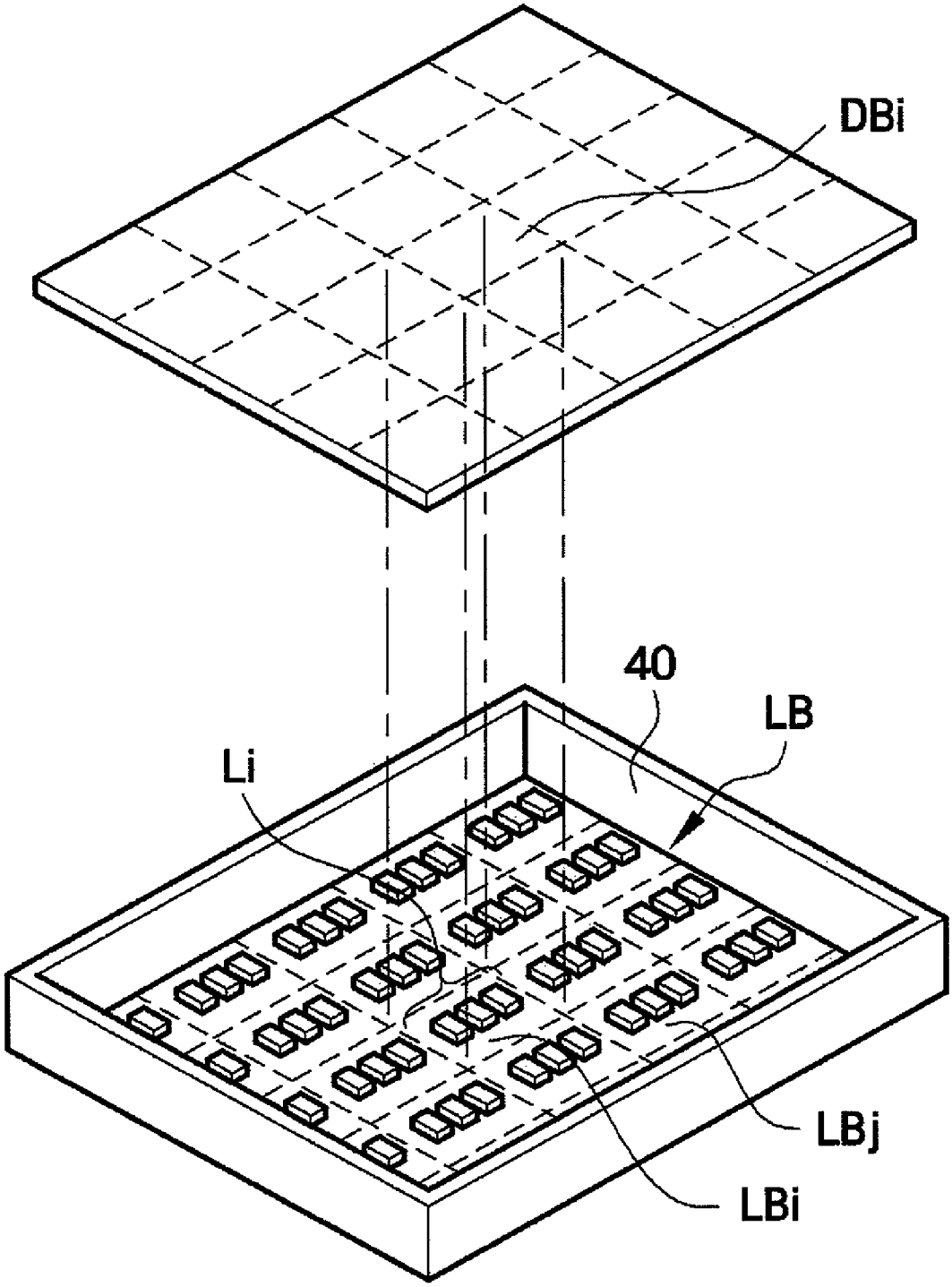
FIG. 5A is a perspective view illustrating the LCD panel, side members and the plurality of light-emitting blocks shown in FIG. 1.

A timing controller according to an exemplary embodiment of the present invention, a liquid crystal display (LCD) including the same, and a driving method of the LCD will be described with reference to FIGS. 1 through 5E. FIG. 1 is an exploded perspective view of a liquid crystal display (LCD) according to an exemplary embodiment of the present invention, FIG. 2 is a block diagram of the liquid crystal display (LCD) shown in FIG. 1, including a timing controller, according to an exemplary embodiment of the present invention, FIG. 3 is an equivalent circuit diagram of one pixel of the LCD shown in FIG. 1, FIG. 4 is a block diagram of the timing controller shown in FIG. 1, FIG. 5A is a perspective view illustrating the LCD panel, side members and the plurality of light-emitting blocks shown in FIG. 1, and FIGS. 5B through 5E are conceptual diagrams for explaining the operation of the intermediate-brightness-determining unit shown in FIG. 4.

Figure 2:
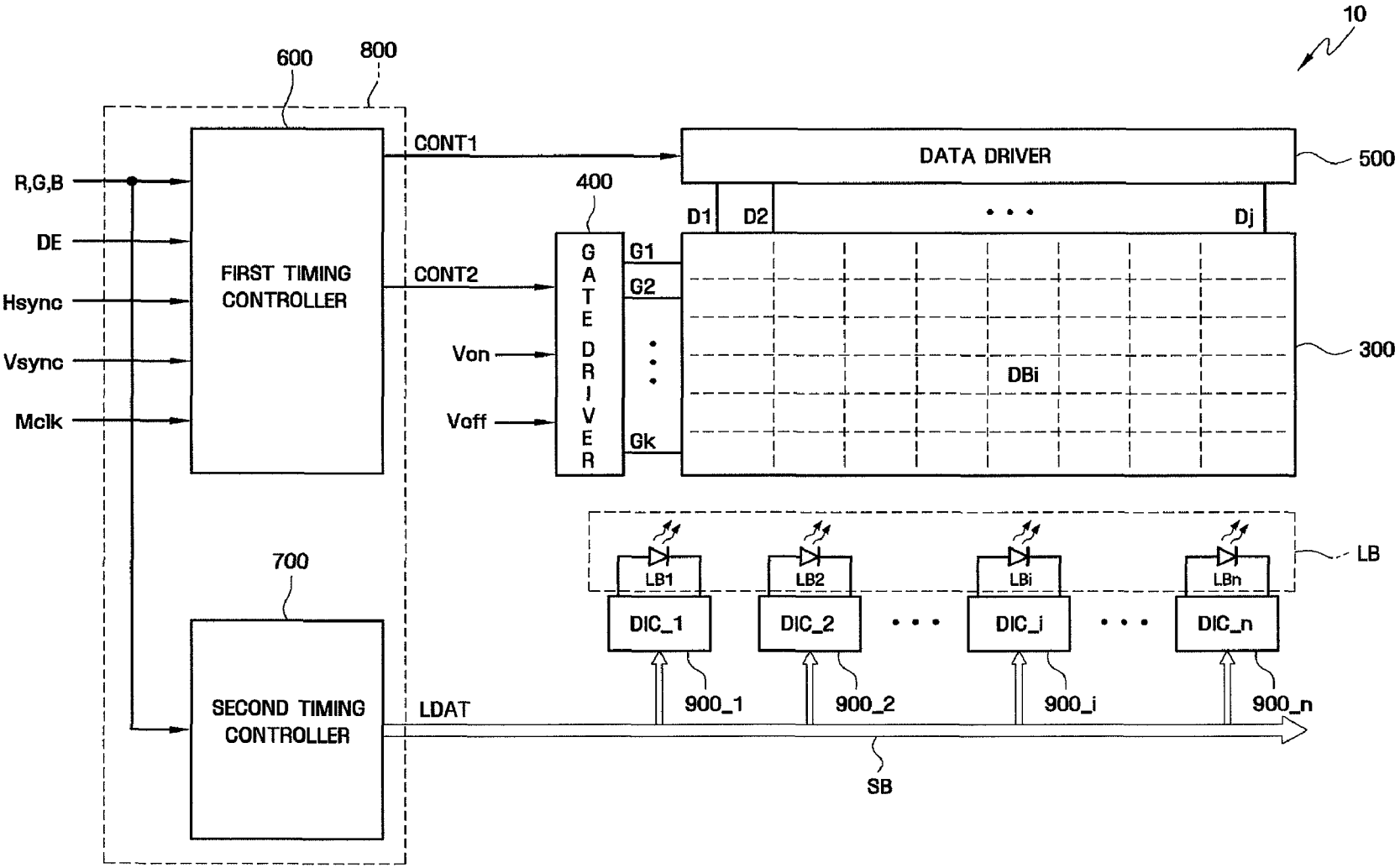
FIG. 2 is a block diagram of a liquid crystal display (LCD) including a timing controller according to an exemplary embodiment of the present invention.

Referring to FIGS. 1 and 2, the LCD 10 includes an LCD panel assembly 30, a backlight assembly 80, a top chassis 20, and a bottom chassis 70.

The LCD panel assembly 30 includes an LCD panel 300, a gate driver 400, a data driver 500, and a timing controller 800.

The LCD panel 300 may be divided into a plurality of display blocks DBi, and each of the display blocks DBi includes a plurality of pixels. The LCD panel 300 includes a plurality of gate lines G1-Gk and a plurality of data lines D1-Dj.

FIG. 3 is an equivalent circuit diagram of one pixel of the LCD shown in FIGS. 1 and 2. Referring to FIG. 3, each pixel PX connected to the f-th gate line $G_f$ (where f=1–i) and the g-th data line $D_g$ (where g=1–j) includes a switching element Qp connected to the gate line $G_f$ and the data line $D_g$, a liquid crystal capacitor Clc connected to the switching element Qp, and a storage capacitor Cst. The liquid crystal capacitor Clc includes a pixel electrode PE of a first panel 100, and a common electrode CE of a second panel 200. A color filter CF is formed in a region of the common electrode CE.

The gate driver 400 receives a gate control signal CONT2 from a first timing controller 600 and applies a gate signal to the gate lines G1-Gk. In this exemplary embodiment, the gate signal is composed of a combination of a gate-ON voltage Von and a gate-OFF voltage Voff supplied from a gate on/off voltage generator (not shown). The gate control signal CONT2 is a signal for controlling the operation of the gate driver 400, and may include a vertical start signal for starting the operation of the gate driver 400, a gate clock signal for determining an output time of the gate-ON voltage, and an output enable signal for determining a pulse width of the gate-ON voltage.

The data driver 500 receives a data control signal CONT1 from the first timing controller 600 and applies image data voltages to data lines D1-Dj. The data control signal CONT1 includes image data corresponding to red, green, and blue signals R, G, B and signals for controlling the operation of the data driver 500. The signals for controlling the operation of the data driver 500 may include a horizontal synchronization start signal indicating a start of the operation of the data driver 500, and an output instruction signal for instructing an output of image data voltages.

The gate driver 400 or the data driver 500 is mounted on a flexible printed circuit film (not shown) attached to the LCD panel 300 in the form of a tape carrier package. In contrast, the gate driver 400 or the data driver 500 may be integrated on the LCD panel 300 together with the display signal lines G1-Gk and D1-Dj and switching elements Qp.

On a circuit board 160 are mounted circuits that generate the gate control signal CONT2 supplied to the gate driver 400, and circuits that generate the data control signal CONT1 supplied to the data driver 500. For example, the timing controller 800 may be mounted on the circuit board 160.

The LCD panel assembly 30 is positioned over the backlight assembly 80 and receives light used to display images.

The backlight assembly 80 may include a side member 40, optical sheets 50, an optical plate 60, and a light source unit consisting of a plurality of light-emitting blocks LB.

The side member 40 supports the LCD panel assembly 30, and receives the optical sheets 50, the optical plate 60 and the light source unit, that is, the plurality of light-emitting blocks LB.

The inner sides of the side member 40 can reflect the light emitted from the plurality of light-emitting blocks LB.

The optical sheets 50 are installed over the optical plate 60, and diffuse and collect the light emitted from the plurality of light-emitting blocks LB. The optical plate 60 may be installed over the plurality of light-emitting blocks LB and may improve the brightness uniformity of the light generated from the plurality of light-emitting blocks LB.

The plurality of light-emitting blocks LB emit light. Each of the plurality of light-emitting blocks LB includes a light emitting element, which may be a light emitting diode (LED). The brightness of each light-emitting block LB can be controlled by the image displayed on the LCD panel 300. For example, the LCD panel is divided into a plurality of display blocks DBi corresponding to the plurality of light-emitting blocks LB1-LBn. The brightness of the respective light-emitting blocks LB1-LBn can be controlled by the images of the respective display blocks DBi.

The bottom chassis 70 and the top chassis 20 receive the LCD panel assembly 30 and the backlight assembly 80. The top chassis 20 can be fastened with the bottom chassis 70 through a hook connection (not shown) and/or a thread connection (not shown).

The timing controller 800 can be functionally divided into a first timing controller 600 and a second timing controller 700. The first timing controller 600 may control images displayed on the LCD panel 300, and the second timing controller 700 may provide light data LDAT to first to nth backlight drivers 900_1~**900_*n***.

The first timing controller 600 and the second timing controller 700 may not be physically separated from each other. In contrast, the first timing controller 600 and the second timing controller 700 may be physically separated from each other, as shown in FIG. 2. For example, the first timing controller 600 may be mounted on the circuit board 160 and the second timing controller 700 may be positioned on a bottom surface of the bottom chassis 70 to be connected to the plurality of light-emitting blocks LB.

The first timing controller 600 receives the R, G, B signals and external control signals Vsync, Hsync, Mclk, and DE for controlling the displaying of the R, G, B signals from an external graphic controller (not shown). Based on the R, G, B signals and the external control signals Vsync, Hsync, Mclk, and DE, the data control signal CONT1 and the gate control signal CONT2 are generated. Examples of the external control signals include a vertical synchronization signal Vsync, a horizontal synchronization signal Hsync, a main clock Mclk, a data enable signal DE, and so on.

The second timing controller 700 receives the R, G, B signals and provides light data LDAT to the first to nth backlight drivers **900_1~900_*n* via a serial bus SB. For example, the serial bus SB may be, but is not limited to, an Integrated Circuit Bus (12C). The second timing controller 700 may provide light data LDAT to the first to nth backlight drivers 900_1~900_*n* in various ways, and a detailed explanation about the second timing controller 700** is set forth hereinafter.

The first to nth backlight drivers **900_1~900_*n* control the brightness of each of the respective light-emitting blocks LB1~LBn in response to the light data LDAT. For example, the first to nth backlight drivers 900_1~900_*n* may control the brightness of each of the light-emitting blocks LB by outputting pulse width modulation signals in response to the light data LDAT. Alternatively, the first to nth backlight drivers 900_1~900_*n* may control the brightness of each of the light-emitting blocks LB1~LBn by adjusting the amount of current supplied to each light-emitting block LB in response to the light data LDAT. In the present invention, the method of the respective backlight drivers 900_1~900_*n* controlling the light-emitting blocks LB1**~LBn is not limited to the illustrated exemplary embodiment.

The second timing controller 700 will now be described in more detail.

Referring to FIGS. 2 and 4, the second timing controller 700 includes an initial brightness-determination unit 710 and a final-brightness-determination unit 720. The initial brightness-determination unit 710 receives the R, G, B signals supplied to an ith display block DBi and determines an initial brightness of an ith light-emitting block LBi. The final-brightness-determination unit 720 receives initial brightness information IB and determines a final brightness of an ith light-emitting block LBi. The final-brightness-determination unit 720 determines the final brightness of the ith light-emitting block LBi by adding the initial brightness IB of the ith light-emitting block LBi, reflected brightness determined by the light reflected from the side members 40 and supplied to the ith light-emitting block LBi, and spreading brightness of a jth light-emitting block LBj for the ith light-emitting block LBi (the spreading brightness is determined by the light spread from the jth light-emitting block LBj) to the ith light-emitting block LBi ($1 \leqq j \leqq n$, $i \neq j$). The final-brightness-determination unit 720 supplies light data LDAT corresponding to the final brightness to the ith light-emitting block LBi, which will now be described in more detail with reference to FIGS. 5A through 5E.

FIG. 5A illustrates an LCD panel 300 of FIGS. 1 and 2 divided into a plurality of display blocks DBi, a plurality of light-emitting blocks LBi, and a side member 40 surrounding and receiving the plurality of light-emitting blocks LBi. The ith display block DBi corresponds the ith light-emitting block LBi.

First, the initial brightness-determination unit 710 determines the initial brightness of the ith display block DBi (described in the following).

Figure 5B:
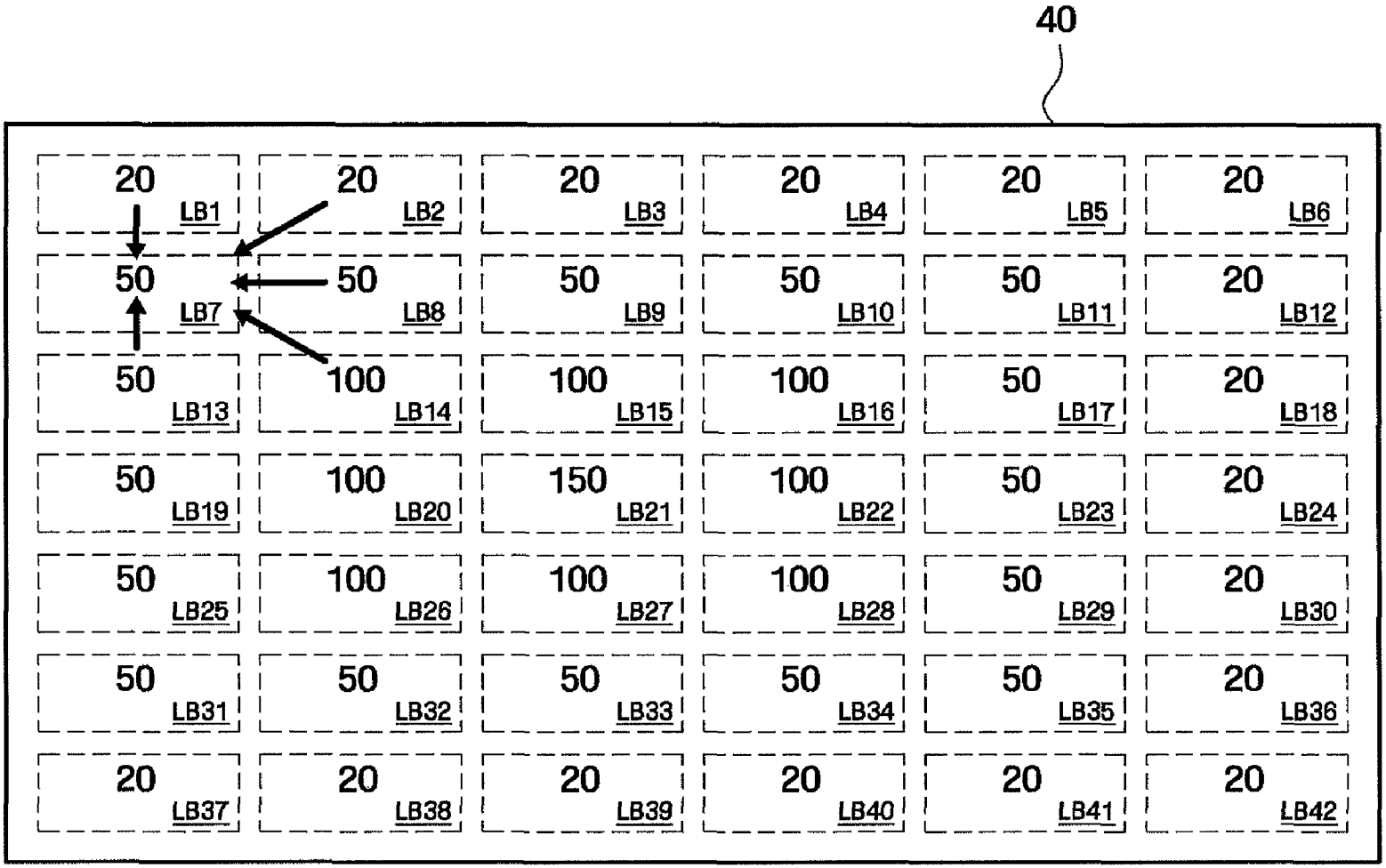

The initial brightness-determination unit 710 receives the R, G, B signals supplied to the ith display block DBi and determines the initial brightness of the ith light-emitting block LBi. For example, when an image displayed on a central portion of the LCD panel 300 is brighter than an image displayed on an edge of the LCD panel 300, the initial brightness of each of the respective light-emitting blocks LB1~LB42, is determined by the initial brightness-determination unit 710, as shown in FIG. 5B. That is, among the first to 42nd light-emitting blocks LB1~LB42, the initial brightness of the 21st light-emitting block LB21 in the central portion may be 150 nit, the initial brightness of the first light-emitting block LB1 in the edge portion may be 20 nit, and the initial brightness of the 7th light-emitting block LB7 may be 50 nit. A nit is also known as a candela per square meter. In this exemplary embodiment, the initial brightness-determination unit 710 may be a look-up table (not shown) storing initial brightnesses for the R, G, B signals.

Next, a method of determining a medium brightness of each of the respective display blocks LB1~LB42 by the final-brightness-determination unit 720 will be described. The final-brightness-determination unit 720 determines the final brightness by adding a spreading brightness of a jth light-emitting block LBj for the ith light-emitting block LBi ($1 \leqq j \leqq n$, $i \neq j$), reflected brightness determined by the light reflected from the side members 40 and supplied to the ith light-emitting block LBi ($1 \leqq i \leqq 42$), and the initial brightness.

First, the final-brightness-determination unit 720 determines the spreading brightness of the jth light-emitting block LBj ($1 \leqq j \leqq 42$, $j \neq i$) for the ith light-emitting block LBi ($1 \leqq i \leqq 42$), which will now be described with reference to FIGS. 5B through 5D.

For example, light emitted from the first light-emitting block LB1, the second light-emitting block LB2, the 8th light-emitting block LB8, the 13th light-emitting block LB13, and the 14th light-emitting block LB14 may be spread and supplied to the 7th light-emitting block LB7. The intensity of light spread from the jth light-emitting block LBj (j=1, 2, 8, 13, 14) is determined by the initial brightness of the jth light-emitting block LBj (j=1, 2, 8, 13, 14) and the positional relationship between the jth light-emitting block LBj (j=1, 2, 8, 13, 14) and the 7th light-emitting block LB7. For example, the greater the initial brightness of the jth light-emitting block LBj (j=1, 2, 8, 13, 14), and the closer the distance between the jth light-emitting block LBj (j=1, 2, 8, 13, 14) and the 7th light-emitting block LB7, the greater the spreading brightness of the jth light-emitting block LBj (j=1, 2, 8, 13, 14) for the 7th light-emitting block LB.

The final-brightness-determination unit 720 may use a window W shown in FIG. 5C to determine the spreading brightness of the first light-emitting block LB1 for the 7th light-emitting block LB7. The window W shown in FIG. 5C is shaped as a matrix, for example, a 5×5 matrix, and includes a criterion window CW and a plurality of sub windows SW. Spreading coefficients are given to the respective sub windows SW, excluding the criterion window CW.

For example, in order to determine the spreading brightness of the first light-emitting block LB1 for the ith light-emitting block LBi ($2 \leqq i \leqq 42$), the window W shown in FIG. 5C is positioned such that the criterion window CW overlaps the first light-emitting block LB1. In this exemplary embodiment, the spreading brightness of the first light-emitting block LB1 for the second light-emitting block LB2 is 6 (=0.3×20)

nit. That is, the spreading brightness of the first light-emitting block LB for the second light-emitting block LB2 is a product of the spreading brightness of a sub window overlapping with the second light-emitting block LB2, that is, 0.3, and initial brightness of the first light-emitting block LB1, that is, 20. In addition, the spreading brightness of the first light-emitting block LB1 for the 7th light-emitting block LB7 is 10 (=0.5×20) nit.

In this exemplary embodiment, the spreading coefficients are different depending on the positional relationship between the ith light-emitting block LBi (1≦i≦42) and the jth light-emitting block LBj (i≠j). Although not shown, if the window W is positioned such that the criterion window CW overlaps with the second light-emitting block LB2, the spreading brightness of the second light-emitting block LB2 for the ith light-emitting block LBi (1≦i≦42, i≠2) is determined. In the same manner, the windows W are sequentially positioned such that the criterion window CW overlaps with each of the light-emitting blocks LBj, thereby determining the spreading brightness of the jth light-emitting block LBj (i≠j) for the ith light-emitting block LBi (1≦i≦42).

Next, a method of determining the reflected brightness of the jth light-emitting block LBj (i≠j) for the ith light-emitting block LBi (1≦i≦n) by means of the final-brightness-determination unit 720 will be described with reference to FIGS. 5D and 5E.

Figure 5D:
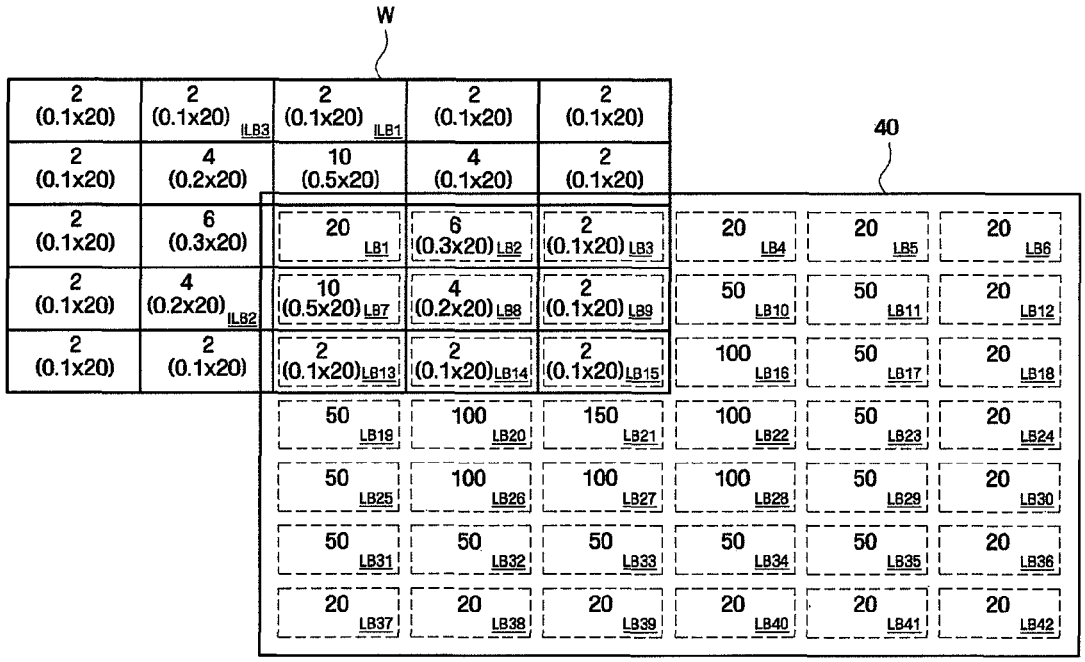
Figure 5E:
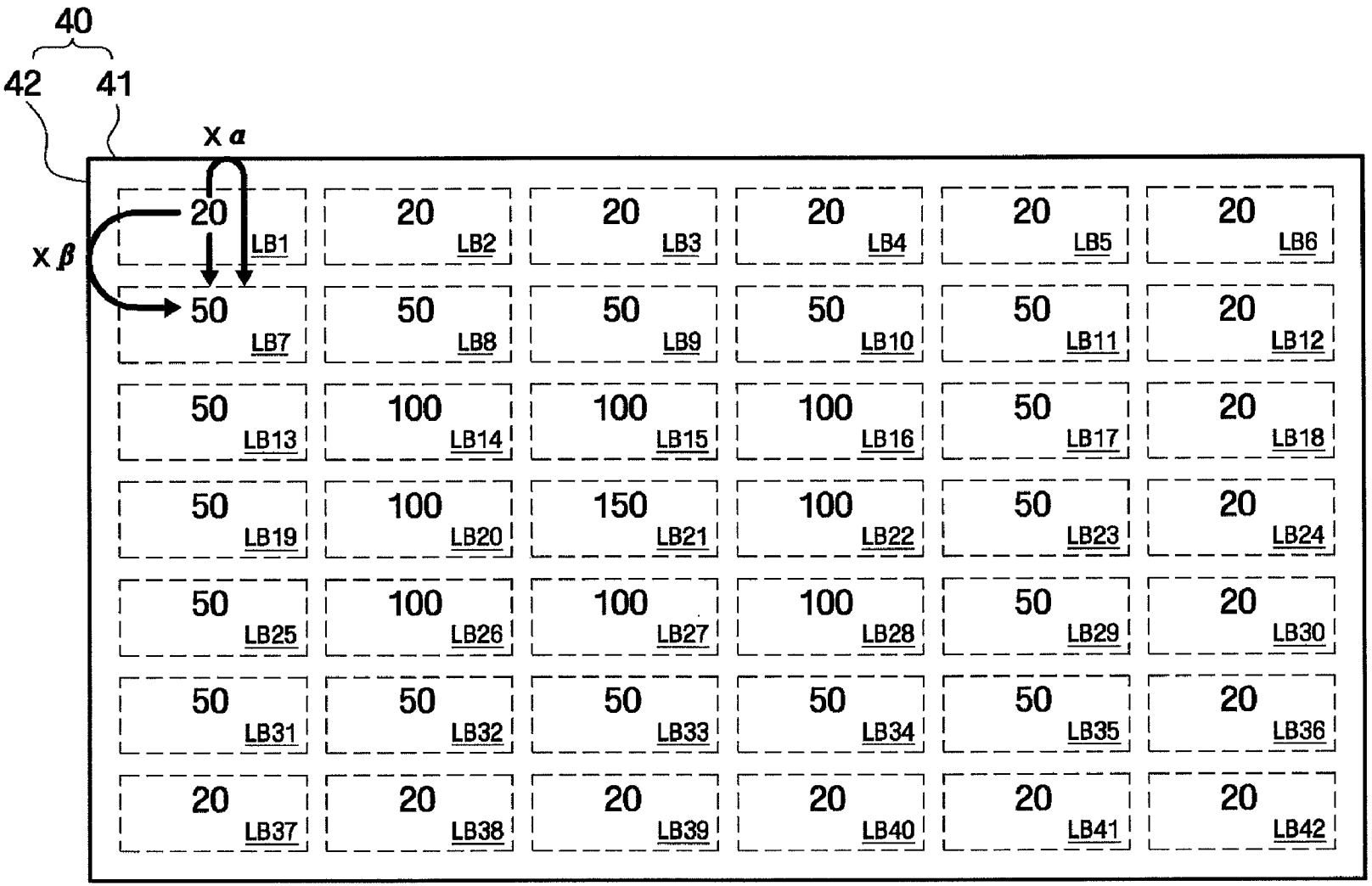

Referring first to FIG. 5E, the light emitted from the first light-emitting block LB1 is reflected by the side member 40, and the reflected light is supplied to the 7th light-emitting block LB7. For example, as shown in FIG. 5E, assuming that the side member 40 includes a first inner surface 41 of a first direction and a second inner surface 42 of a second direction, the first inner surface 41 has a first reflection coefficient α, and the second inner surface 42 has a second reflection coefficient β, the reflected brightness of the first light-emitting block LB1 for the 7th light-emitting block LB7 is determined by the initial brightness of the first light-emitting block LB1, that is, 20, the first reflection coefficient α, and the second reflection coefficient β.

If it is assumed that the side member 40 is not provided in FIG. 5D, the light spread from the first light-emitting block LB1 is supplied to a plurality of imaginary light-emitting blocks ILB1~LB3. For example, the spreading brightness of the first light-emitting block LB1 for a first imaginary light-emitting block ILB1 is 2 (=0.1×20) nit. In addition, the spreading brightness of the first light-emitting block LB1 for a second imaginary light-emitting block ILB2 is 4 (=0.2×20) nit. Further, the spreading brightness of the first light-emitting block LB1 for a third imaginary light-emitting block ILB3 is 2 (=0.1×20) nit. Because the side member 40 exists, however, the light supplied to the first to the third imaginary light-emitting blocks ILB1~LB3 is reflected by the side member 40 and transmitted to the 7th light-emitting block LB7 in the side member 40.

In this exemplary embodiment, the first imaginary light-emitting block ILB1 is symmetrical with the 7th light-emitting block LB7 in view of the first inner surface 41. Accordingly, the brightness obtained by multiplying the spreading brightness of the first light-emitting block LB1 for the first imaginary light-emitting block ILB1 by the first reflection coefficient α is supplied to the 7th light-emitting block LB7. In addition, the second imaginary light-emitting block ILB2 is symmetrical with the 7th light-emitting block LB7 in view of the second inner surface 42. Accordingly, the brightness obtained by multiplying the spreading brightness of first light-emitting block LB1 for the second imaginary light-emitting block ILB2 by the second reflection coefficient β is supplied to the 7th light-emitting block LB7. In addition, the third imaginary light-emitting block ILB3 is symmetrical with the 7th light-emitting block LB7 in view of the first inner surface 41 and the second inner surface 42. Accordingly, the brightness obtained by multiplying the spreading brightness of the first light-emitting block LB1 for the third imaginary light-emitting block ILB3 by the first reflection coefficient α is supplied to the 7th light-emitting block LB7. In this manner, the final-brightness-determination unit 710 determines the reflected brightness of the jth light-emitting block LBj (i≠j) for the ith light-emitting block LBi (1≦i≦42).

Next, the final-brightness-determination unit 720 determines the final brightness by adding the predetermined initial brightness of the ith light-emitting block LBi (1≦i≦42), the spreading brightness of the jth light-emitting block LBj (i≠j) for the ith light-emitting block LBi (1≦i≦42), and the reflected brightness of the jth light-emitting block LBj (i≠j) for the ith light-emitting block LBi (1≦i≦42). The final-brightness-determination unit 720 then supplies the light data LDAT corresponding to the final brightness to the first to the nth backlight drivers 900_1~900_*n*.

In summary, the timing controller 800 determines the final brightness in consideration of the reflected brightness from the side member 40 and supplies the light data LDAT corresponding to the final brightness, thereby accurately controlling the brightness of each of the light-emitting blocks LB1~LBn. Accordingly, the display quality of the LCD 10 can be improved.

Figure 6:
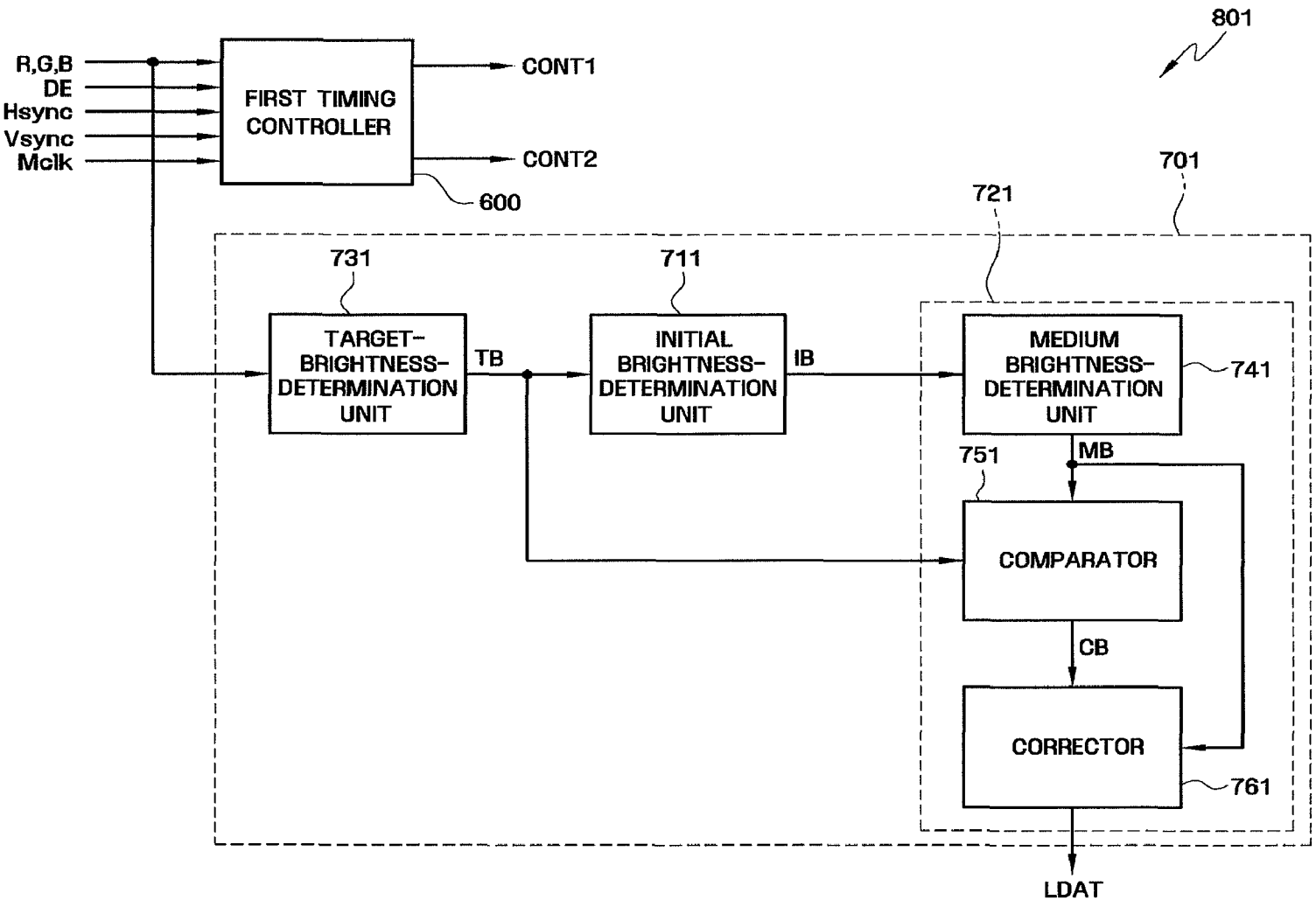
FIG. 6 is a block diagram of a liquid crystal display (LCD) for explaining a timing controller according to an exemplary embodiment of the present invention.

A timing controller, according to an exemplary embodiment of the present invention, an LCD including the same and a driving method of the same will be described with reference to FIG. 6. FIG. 6 is a block diagram of a portion of a liquid crystal display (LCD) for explaining a timing controller according to an exemplary embodiment of the present invention, the LCD including the timing controller, and a driving method of the LCD. In FIG. 6, the same reference numerals denote the same elements as in FIGS. 2 and 4, and thus any further descriptions of the same elements will be omitted.

Referring to FIG. 6, unlike in the above-described exemplary embodiment, a timing controller 801 further includes a target-brightness-determination unit 731, and a final-brightness-determination unit 721 that includes a medium-brightness-determination unit 741, a comparator 751 and a corrector 761.

The target-brightness-determination unit 731 receives the R, G, and B signals supplied to, for example, the ith display block DBi, determines the target brightness of the ith light-emitting block LBi corresponding to the R, G, and B signals and supplies target brightness information TB to the initial brightness-determination unit 711. The initial brightness-determination unit 711 receives the target brightness information TB, determines the initial brightness of the ith light-emitting block LBi corresponding to the target brightness of the ith light-emitting block LBi and lowers the target brightness, and supplies initial brightness information IB to the medium-brightness-determination unit 741. As described above, the medium-brightness-determination unit 741 determines the spreading brightness of the jth light-emitting block LBj (i≠j) for the ith light-emitting block LBi and the reflected brightness of the jth light-emitting block LBj (i≠j) for the ith light-emitting block LBi using the initial brightness of the ith light-emitting block LBi. The medium-brightness-determination unit 741 determines the medium brightness by adding the initial brightness of the ith light-emitting block LBi, the spreading brightness of the jth light-emitting block LBj (i≠j) for the ith light-emitting block LBi, and the reflected brightness of the jth light-emitting block LBj (i≠j) for the ith light-emitting block LBi, and supplies medium brightness information MB to the comparator 751. The comparator 751 receives the target brightness information TB and the medium brightness information MB, compares the target brightness information TB with the medium brightness information MB, and supplies the compared brightness information CB to the corrector 761. The corrector 761 receives the compared brightness information CB and outputs the light data LDAT. For example, if the medium brightness is identical to the target brightness, the corrector 761 determines the medium brightness as the final brightness without making a correction and supplies light data LDAT corresponding to the medium brightness. In contrast, if the medium brightness is not identical to the target brightness, the corrector 761 corrects the medium brightness and then determines the corrected medium brightness as the final brightness, and supplies light data LDAT corresponding to the final brightness, which will now be described in detail by way of example.

The target-brightness-determination unit 731 receives R, G, and B signals corresponding to the ith display block DBi, sets the target brightness of the ith light-emitting block LBi to 400 nit, and supplies the target brightness information TB to the initial brightness-determination unit 711. In this exemplary embodiment, the target-brightness-determination unit 731 determines a representative value of the R, G, and B signals supplied to the ith display block DBi, and determines the target brightness according to the representative value of the ith display block DBi. The representative value of the ith display block DBi may be an average value of the R, G, and B signals supplied to the ith display block DBi. Alternatively, the representative value of the ith display block DBi may be a maximum value of the R, G, and B signals supplied to the ith display block DBi. The method of the target-brightness-determination unit 731, however, which determines the target brightness of the ith light-emitting block LBi, is not limited to those illustrated herein.

The initial brightness-determination unit 711 may determine the initial brightness to be 250 nit, which is lower than the target brightness, that is, 400 nit. In this exemplary embodiment, the initial brightness-determination unit 710 may use a look-up table (not shown) storing the initial brightness corresponding to the target brightness.

The medium-brightness-determination unit 741 may determine the spreading brightness of the jth light-emitting block LBj (i≠j) for the ith light-emitting block LBi to be 70 nit, and may determine the reflected brightness of the jth light-emitting block LBj (i≠j) for the ith light-emitting block LBi to be 60 nit. In addition, the medium-brightness-determination unit 741 may set the medium brightness to 380 nit by adding 250 nit as the initial brightness of the ith light-emitting block LBi, 70 nit as the spreading brightness of the jth light-emitting block LBj for the ith light-emitting block LBi (i≠j), and 60 nit as the reflected brightness of the jth light-emitting block LBj for the ith light-emitting block LBi (i≠j). The medium-brightness-determination unit 741 supplies the medium brightness information MB to the comparator 751.

The comparator 751 receives the target brightness information TB and the medium brightness information MB and compares the target brightness information TB with the medium brightness information MB. Because the target brightness is 400 nit and the medium brightness is 380 nit, the comparator 751 supplies the corrector 761 with the compared brightness information CB informing that the medium brightness is 20 nit lower than the target brightness.

The corrector 761 corrects the medium brightness using the compared brightness information CB, and then determines the corrected medium brightness, and supplies the light data LDAT corresponding to the final brightness. For example, the corrector 761 can increase the medium brightness of the ith light-emitting block LBi by increasing the initial brightness of the ith light-emitting block LBi. Alternatively, the corrector 761 can increase the medium brightness of the ith light-emitting block LBi by increasing the spreading brightness of the ith light-emitting block LBi for the jth light-emitting block LBj (i≠j).

Figure 7:
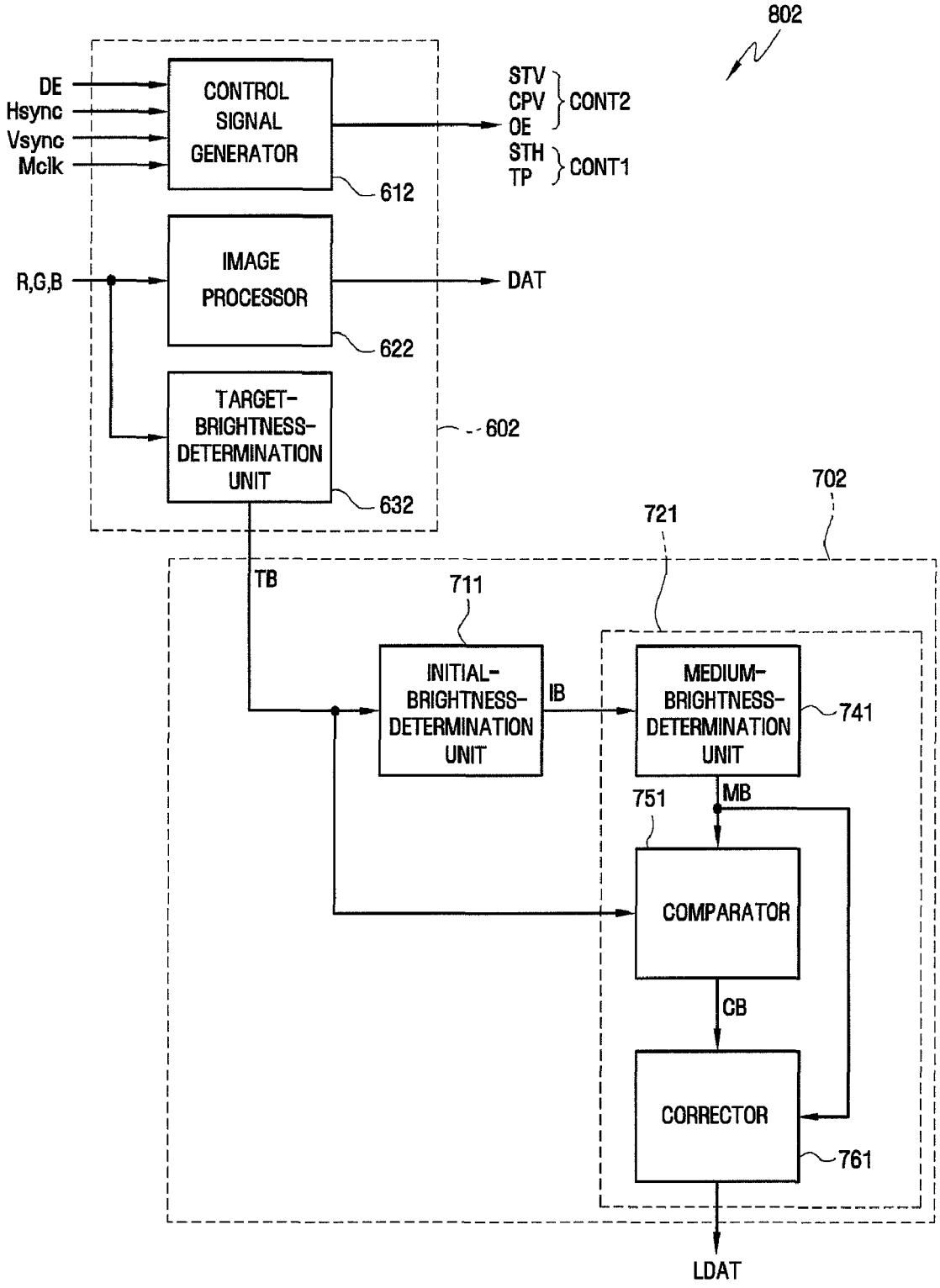
FIG. 7 is a block diagram of a liquid crystal display (LCD) including a timing controller according to an exemplary embodiment of the present invention.

A timing controller according to an exemplary embodiment of the present invention, an LCD including the same and a driving method of the same will be described with reference to FIG. 7. FIG. 7 is a block diagram of a portion of a liquid crystal display (LCD) for explaining a timing controller according to an exemplary embodiment of the present invention, the LCD including the timing controller, and a driving method of the LCD. In FIG. 7, the same reference numerals denote the same elements as in FIG. 6, and thus any further descriptions of the same elements will be omitted.

Referring to FIG. 7, unlike in the above-described exemplary embodiment, a first timing controller 602 includes a target-brightness-determination unit 632.

More specifically, the first timing controller 602 may include a control signal generator 612, an image processor 622, and a target-brightness-determination unit 632. The control signal generator 612 receives external control signals Vsync, Hsync, Mclk, and DE and outputs a data control signal CONT1 and a gate control signal CONT2. The control signal generator 612 may output, for example, a vertical synchronization start signal STV indicating a start of the operation of the gate driver 400 shown in FIG. 2, a gate clock signal CPV controlling an output timing of a gate-on voltage, an output enable signal OE determining a pulse width of the gate-on voltage, a horizontal synchronization start signal STH indicating a start of the operation of the data driver 500 shown in FIG. 1, an output instruction signal TP instructing an output of image data voltages, and so on.

The image processor 622 receives R, G, and B signals of the ith display block DBi, processes the same, and outputs image data DAT.

The target-brightness-determination unit 632 receives the R, G, and B signals corresponding to the ith display block DBi, determines the target brightness according to a representative value of the ith display block DBi, and supplies target brightness information TB to the second timing controller 702. The representative value of the ith display block DBi may be an average value of the R, G, and B signals supplied to the ith display block DBi. Alternatively, the representative value of the ith display block DBi may be a maximum value of the R, G, and B signals supplied to the ith display block DBi. The method of the target-brightness-determination unit 632 determining the target brightness of the ith light-emitting block LBi, however, is not limited to those illustrated herein.

The second timing controller 702 includes an initial brightness-determination unit 711, a medium-brightness-determination unit 741, a comparator 751, and a corrector 761. The second timing controller 702 receives target brightness information TB of the ith light-emitting block LBi from the first timing controller 602 and outputs the light data LDAT.

Figure 8:
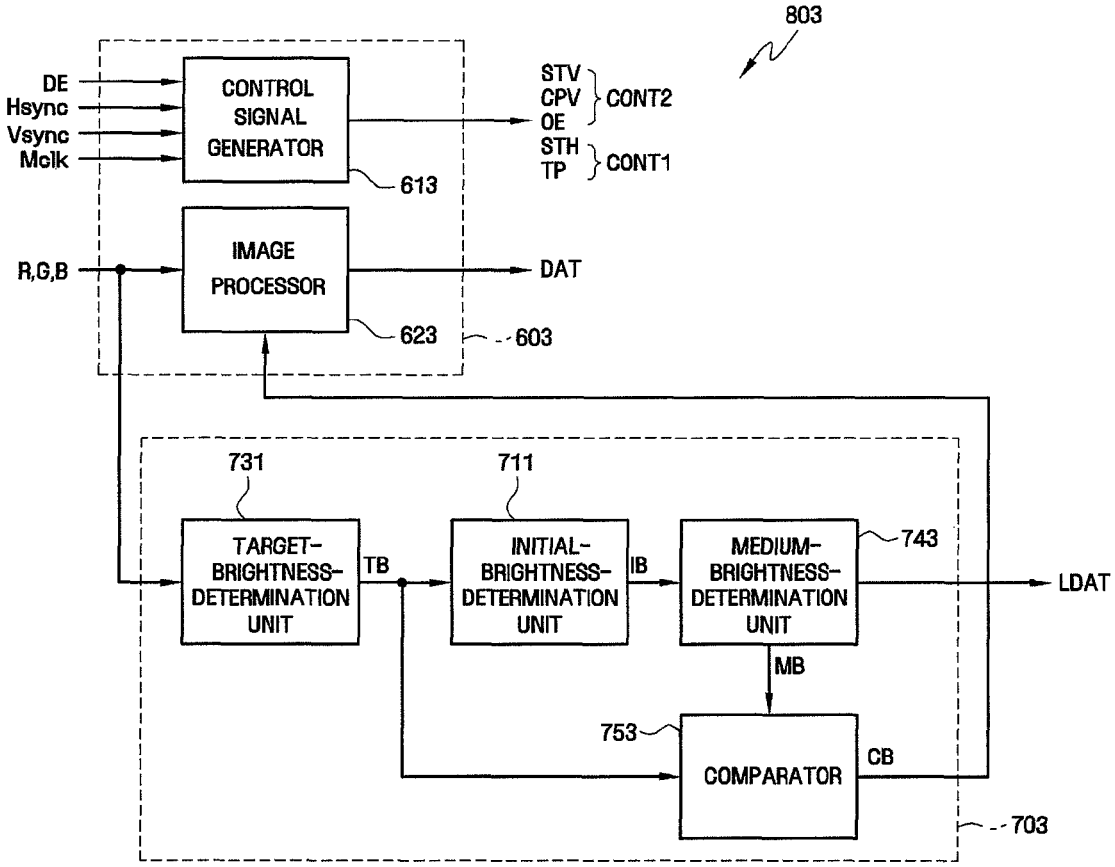
FIG. 8 is a block diagram of a liquid crystal display (LCD) including a timing controller according to an exemplary embodiment of the present invention.

A timing controller according to an exemplary embodiment of the present invention, an LCD including the same and a driving method of the same will be described with reference to FIG. 8. FIG. 8 is a block diagram of a portion of a liquid crystal display (LCD) for explaining a timing controller according to an exemplary embodiment of the present invention, the LCD including the timing controller, and a driving method of the LCD. In FIG. 8, the same reference numerals denote the same elements as in FIGS. 6 and 7, and thus any further descriptions of the same elements will be omitted.

Referring to FIG. 8, a comparator 753 supplies compared brightness information CB to a first timing controller 603, while a second timing controller 703 does not include a corrector (761 shown in FIG. 7), unlike in the above-described exemplary embodiment. That is, if the target brightness is not identical to the medium brightness, the first timing controller 603 changes grays of the image data DAT without correcting the medium brightness.

More specifically, the medium-brightness-determination unit 743 determines the medium brightness as the final brightness, and outputs light data LDAT corresponding to the medium brightness. The comparator 753 receives medium brightness information MB and target brightness information TB, compares the medium brightness information MB with the target brightness information TB, and supplies the compared brightness information CB to the image processor 623. If the target brightness is higher than the medium brightness, the image processor 623 outputs image data DAT having a higher gray scale than that corresponding to the received R, G, and B signals.

That is, even if the final brightness of the ith light-emitting block LBi is lower than the target brightness, the gray scale of the image data DAT supplied to the ith display block DBi may be increased, so that the brightness of the ith display block DBi may become equal to the target brightness. Alternatively, if the medium brightness is higher than the target brightness, the image processor 623 outputs image data DAT having a lower gray scale than that corresponding to the received R, G, and B signals. That is, even if the final brightness of the ith light-emitting block LBi is higher than the target brightness, the gray scale of the image data DAT supplied to the ith display block DBi may be decreased, so that the brightness of the ith display block DBi may become equal to the target brightness.

The present invention is not limited to the illustrated example, however, and the target-brightness-determination unit 731 of the second timing controller 703 may be incorporated into the first timing controller 603.

Figure 9:
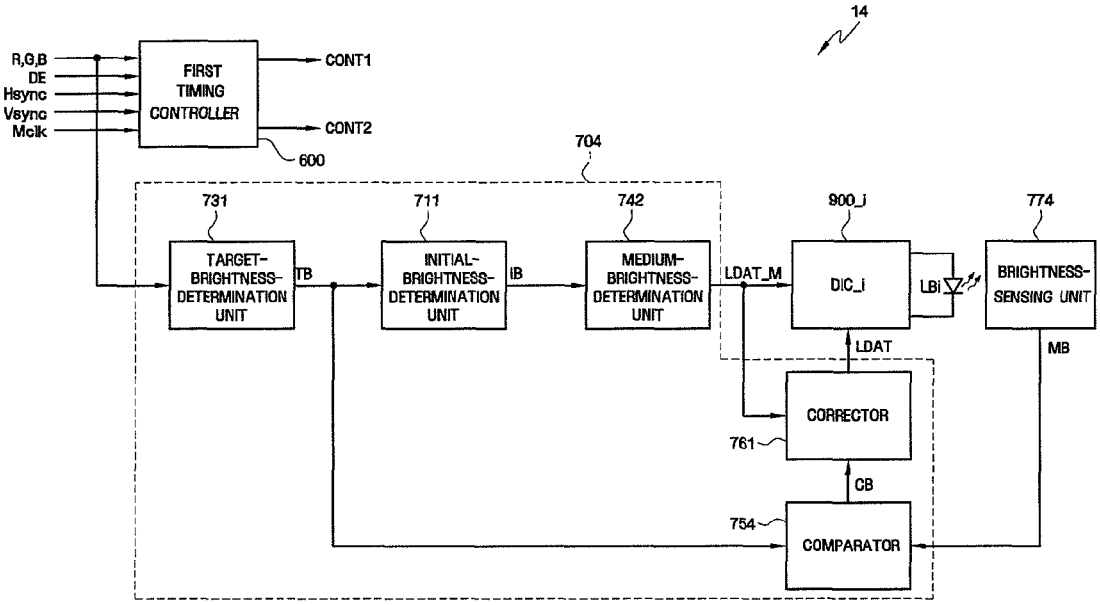
FIG. 9 is a block diagram of a liquid crystal display (LCD) including a timing controller according to an exemplary embodiment of the present invention.

A timing controller according to an exemplary embodiment of the present invention, an LCD including the timing controller, and a driving method of the LCD, will now be described with reference to FIG. 9. FIG. 9 is a block diagram of a portion of a liquid crystal display (LCD) for explaining a timing controller according to an exemplary embodiment of the present invention, the LCD including the timing controller, and a driving method of the LCD. In FIG. 9, the same reference numerals denote the same elements as in FIG. 6, and thus any further descriptions of the same elements will be omitted.

Referring to FIG. 9, unlike in the above-described exemplary embodiment, an LCD 14 includes a target brightness-determination unit 731, an initial-brightness-determination unit 711, a medium-brightness-determination unit 742, a comparator 754, and a corrector 761.

The LCD 14 further includes a brightness-sensing unit 774. The second timing controller 704 supplies medium light data LDAT_M corresponding to medium brightness to an ith backlight driver 900_*i*, corrects the medium light data LDAT_M according to the brightness of the ith light-emitting block LBi measured by the brightness-sensing unit 774, and supplies final light data LDAT to the ith backlight driver 900_*i*.

More specifically, the medium-brightness-determination unit 742 receives initial brightness information IB, determines the medium brightness, and supplies medium light data LDAT_M corresponding to the medium brightness to the ith backlight driver 900_*i*. The ith backlight driver 900_*i* adjusts the brightness of the ith light-emitting block LBi in response to the medium light data LDAT_M. The brightness-sensing unit 774 receives light emitted from the ith light-emitting block LBi, measures the brightness of the ith light-emitting block LBi, and supplies the measured brightness information MB to the comparator 754. The comparator 754 receives and compares the target brightness information TB and measured brightness information MB and supplies compared brightness information CB to the corrector 761. For example, if the target brightness information TB is identical to the measured brightness information MB, the corrector 761 supplies the medium light data LDAT_M as the final light data LDAT to the ith backlight driver 900_*i* without correcting the medium light data LDAT_M. In contrast, if the target brightness information TB is not identical to the measured brightness information MB, the corrector 761 corrects the medium light data LDAT_M and then supplies the corrected medium light data LDAT_M as the final light data LDAT to the ith backlight driver 900_*i*.

The present invention is not limited to the illustrated example, however, and the target-brightness-determination unit 731 of the second timing controller 704 may be incorporated into the first timing controller 600. Further, the second timing controller 704 may not include the corrector 761. In this case, the comparator 754 may supply the compared brightness information CB to the first timing controller 600, and the first timing controller 600 may change the gray scale of the image data DAT.

While the present invention has been particularly shown and described with reference to exemplary embodiments thereof, it will be understood by those of ordinary skill in the art that various changes in form and details may be made therein without departing from the spirit and scope of the present invention, as defined by the following claims. It is therefore desired that the exemplary embodiments be considered in all respects as illustrative and not restrictive, reference being made to the appended claims rather than the foregoing description to indicate the scope of the invention.

What is claimed is:

1. A liquid crystal display (LCD) comprising:

an LCD panel;

a light source unit divided into n light-emitting blocks providing light to the LCD panel;

a side member reflecting the light emitted from the light source unit;

a timing controller determining a final brightness of each of the n light-emitting blocks and providing final light data corresponding to the determined final brightness, the final brightness being determined using a reflected brightness based on light reflected from the side member; and a backlight driver controlling the brightness of each of the n light-emitting blocks in response to the final light data.

2. The LCD of claim 1, wherein the timing controller receives image data, determines an initial brightness of each of the light-emitting blocks corresponding to the image data, and determines the final brightness of each of the light-emitting blocks using the initial brightness and the reflected brightness.

3. The LCD of claim 2, wherein the timing controller determines the final brightness of each of the light-emitting blocks by adding the initial brightness of each of the light-emitting blocks, the reflected brightness, and a spreading brightness determined by the light spread from other light-emitting blocks.

4. The LCD of claim 1, wherein the timing controller receives image data and determines a target brightness of the ith light-emitting block ($1 \leqq i \leqq n$); determines an initial brightness of the ith light-emitting block corresponding to the target brightness of the ith light-emitting block and lower than the target brightness; determines a spreading brightness of the jth light-emitting block for the ith light-emitting block ($1 \leqq j \leqq n$, $j \neq i$), the spreading brightness being determined by the light spread from the jth light-emitting block; determines the medium brightness of the ith light-emitting block by adding the initial brightness, the reflected brightness, and the spreading brightness; and compares the target brightness with the medium brightness, corrects the medium brightness according to the comparison result and determines the final brightness of the ith light-emitting block.

5. The LCD of claim 4, wherein when the side member surrounds the first to the nth light-emitting blocks, the ith light-emitting block is present at an ith position in view of the jth light-emitting block, the ith light-emitting block is symmetrical with a kth imaginary light-emitting block positioned outside the side member in view of the side member, and the kth imaginary light-emitting block is present at a kth position in view of the jth light-emitting block, the timing controller determines the spreading brightness of the jth light-emitting block for the ith light-emitting block by multiplying the ith spreading coefficient by the initial brightness of the jth light-emitting block; determines the spreading brightness of the jth light-emitting block for the kth imaginary light-emitting block by multiplying the kth spreading coefficient by the initial brightness of the jth light-emitting block; determines the reflected brightness of the jth light-emitting block for the ith light-emitting block by multiplying the spreading brightness of the jth light-emitting block for the kth imaginary light-emitting block by a reflection coefficient of the side member; and determines the final brightness of the ith light-emitting block by adding the initial brightness of the ith light-emitting block, the spreading brightness of the jth light-emitting block for the ith light-emitting block, and the reflected brightness of the jth light-emitting block for the ith light-emitting block.

6. The LCD of claim 5, wherein when the side member includes a first inner surface of a first direction and a second inner surface of a second direction, the timing controller determines the reflected brightness of the jth light-emitting block for the ith light-emitting block by multiplying the spreading brightness of the jth light-emitting block for the kth imaginary light-emitting block and a first reflection coefficient of the first inner surface, if the ith light-emitting block is symmetrical with the kth imaginary light-emitting block in view of the first inner surface; determines the reflected brightness of the jth light-emitting block for the ith light-emitting block by multiplying the spreading brightness of the jth light-emitting block for the kth imaginary light-emitting block and a second reflection coefficient of the second inner surface, if the ith light-emitting block is symmetrical with the kth imaginary light-emitting block in view of the second inner surface; and determines the reflected brightness of the jth light-emitting block for the ith light-emitting block by multiplying the spreading brightness of the jth light-emitting block for the kth imaginary light-emitting block, and first and second reflection coefficients, if the ith light-emitting block is symmetrical with the kth imaginary light-emitting block in view of the first and second inner surfaces.

7. The LCD of claim 1, wherein the timing controller receives image data and determines a target brightness of the ith light-emitting block ($1 \leqq i \leqq n$) and determines an initial brightness of the ith light-emitting block corresponding to the target brightness of the ith light-emitting block and lower than the target brightness; determines a spreading brightness of the jth light-emitting block for the ith light-emitting block ($1 \leqq j \leqq n$, $j \neq i$), the spreading brightness being determined by the light spread from the jth light-emitting block; determines a first medium brightness of the ith light-emitting block by adding the initial brightness, the reflected brightness, and the spreading brightness; and supplies medium light data corresponding to the first median brightness, compares the target brightness with a second medium brightness measured by light emitted from the plurality of light-emitting blocks in response to the medium light data, corrects the medium light data according to the compared brightness information and supplies the final light data.

8. The LCD of claim 7, wherein the LCD further comprises a brightness-sensing unit measuring the second median brightness using the light emitted from the ith light-emitting block in response to the medium light data, and the timing controller includes a target-brightness-determination unit receiving the image data and determining the target brightness of the ith light-emitting block, an initial brightness-determination unit determining the initial brightness corresponding to the target brightness, a median brightness-determination unit determining the first median brightness by adding the initial brightness, the spreading brightness and the reflected brightness, a comparator comparing the second median brightness with the target brightness, and a corrector correcting the medium light data according to compared brightness information and outputting the final light data.

9. The LCD of claim 1, wherein the timing controller includes a target-brightness-determination unit receiving the image data and determining a target brightness of the ith light-emitting block ($1 \leqq i \leqq n$), an initial brightness-determination unit determining an initial brightness of the ith light-emitting block corresponding to the target brightness of the ith light-emitting block and lower than the target brightness, a medium-brightness-determination unit determining a spreading brightness of the jth light-emitting block ($1 \leqq j \leqq n$, $j \neq i$) for the ith light-emitting block ($1 \leqq i \leqq n$) determined by light spread from the jth light-emitting block and determining a medium brightness of the ith light-emitting block by adding the initial brightness, the reflected brightness, and the spreading brightness, and a comparator comparing the target brightness with the median brightness.

10. The LCD of claim 9, wherein the timing controller further includes a corrector correcting the medium brightness according to the compared brightness information and determining the final brightness of the ith light-emitting block.

11. The LCD of claim 10, wherein each of the plurality of light-emitting blocks includes a light-emitting element and the light-emitting element is a light-emitting diode.

12. The LCD of claim 1, wherein the LCD panel is divided into 1st to nth display blocks corresponding to the 1st to the nth light-emitting blocks, and a brightness of each of the display blocks is controlled by images displayed thereon.

13. A timing controller supplying light data to a light source unit surrounded by a side member reflecting light and divided into a plurality of light-emitting blocks, the timing controller comprising:

a target-brightness-determination unit receiving image data and determining a target brightness of the ith light-emitting block ($1 \leqq i \leqq n$);

an initial brightness-determination unit determining an initial brightness of the ith light-emitting block corresponding to the target brightness of the ith light-emitting block and lower than the target brightness;

a medium-brightness-determination unit determining a spreading brightness of the jth light-emitting block for ith light-emitting block ($1 \leqq i \leqq n$) determined by light spread from the jth light-emitting block ($1 \leqq j \leqq n, j \neq i$), determining a reflected brightness of the jth light-emitting block for the ith light-emitting block, and determining a medium brightness of the ith light-emitting block by adding the initial brightness, the reflected brightness and the spreading brightness, the reflected brightness of the jth light-emitting block for the ith light-emitting block being determined by the light emitted from the jth light-emitting block, reflected by the side member;

a comparator comparing the medium brightness with the target brightness; and a corrector correcting the medium brightness according to the compared brightness information, determining the final brightness of the ith light-emitting block, and supplying the light data corresponding the initial brightness.

14. The timing controller of claim 13, wherein when the side member surrounds the first to the nth light-emitting blocks, the ith light-emitting block is present at an ith position in view of the jth light-emitting block, the ith light-emitting block is symmetrical with the kth imaginary light-emitting block positioned outside the side member in view of the side member, and the kth imaginary light-emitting block is present at a kth position in view of the jth light-emitting block, the medium-brightness-determination unit determines the spreading brightness of the jth light-emitting block for the ith light-emitting block by multiplying the ith spreading coefficient by the initial brightness of the jth light-emitting block, determines the spreading brightness of the jth light-emitting block for the kth imaginary light-emitting block by multiplying the kth spreading coefficient by the initial brightness of the jth light-emitting block, determines the reflected brightness of the jth light-emitting block for the ith light-emitting block by multiplying the spreading brightness of the jth light-emitting block for the kth imaginary light-emitting block by a reflection coefficient of the side member, and determines the final brightness of the ith light-emitting block by adding the initial brightness of the ith light-emitting block, the spreading brightness of the jth light-emitting block for the ith light-emitting block, and the reflected brightness of the jth light-emitting block for the ith light-emitting block.

15. The timing controller of claim 14, wherein when the side member includes a first inner surface of a first direction and a second inner surface of a second direction, the medium-brightness-determination unit determines the reflected brightness of the jth light-emitting block for the ith light-emitting block by multiplying the spreading brightness of the jth light-emitting block for the kth imaginary light-emitting block and a first reflection coefficient of the first inner surface, if the ith light-emitting block is symmetrical with the kth imaginary light-emitting block in view of the first inner surface, determines the reflected brightness of the jth light-emitting block for the ith light-emitting block by multiplying the spreading brightness of the jth light-emitting block for the kth imaginary light-emitting block and a second reflection coefficient of the second inner surface, if the ith light-emitting block is symmetrical with the kth imaginary light-emitting block in view of the second inner surface, and determines the reflected brightness of the jth light-emitting block for the ith light-emitting block by multiplying the spreading brightness of the jth light-emitting block for the kth imaginary light-emitting block, and first and second reflection coefficients, if the ith light-emitting block is symmetrical with the kth imaginary light-emitting block in view of the first and second inner surfaces.

16. A driving method of a liquid crystal display (LCD) comprising:

providing an LCD comprising an LCD panel, a light source unit divided into a plurality of light-emitting blocks, and a side member reflecting light supplied from the light source unit;

determining a final brightness of each of the plurality of light-emitting blocks, the final brightness being determined using a reflected brightness determined by light reflected from the side member;

supplying light data corresponding to the determined final brightness; and controlling the brightness of one of the plurality of light-emitting blocks in response to the light data.

17. The driving method of claim 16, wherein the determining the final brightness comprises:

receiving image data;

determining an initial brightness of one of the plurality of light-emitting blocks corresponding to the image data; and adding the initial brightness and the reflected brightness.

18. The driving method of claim 16, wherein the determining the final brightness comprises:

receiving image data;

determining an initial brightness of one of the plurality of light-emitting blocks corresponding to the image data;

determining a spreading brightness using light spread from another one of the plurality of light-emitting blocks; and adding the initial brightness, the reflected brightness, and the spreading brightness.

19. The driving method of claim 16, wherein the determining the final brightness comprises:

receiving image data;

determining a target brightness of the light-emitting block corresponding to the image data;

determining the initial brightness corresponding to the target brightness and lower than the target brightness;

determining the spreading brightness using the light spread from another one of the plurality of light-emitting block;

determining a medium brightness by adding the initial brightness, the reflected brightness, and the spreading brightness; and comparing the target brightness with the medium brightness.

20. The driving method of claim 19, wherein the determining the final brightness further comprises correcting the medium brightness according to the compared brightness information.

* * * * *